United States Patent [19]

Hansen

[11] 4,401,271

[45] Aug. 30, 1983

[54] AEROSAL FAN SPRAY HEAD

[75] Inventor: Dennis D. Hansen, Luck Township, Polk County, Wis.

[73] Assignee: Minnesota Mining and Manufacturing Company, St. Paul, Minn.

[21] Appl. No.: 282,243

[22] Filed: Jul. 10, 1981

[51] Int. Cl.[3] ..... B65D 83/14

[52] U.S. Cl. ..... 239/337; 239/592; 239/599

[58] Field of Search ..... 239/337, 592, 594, 595, 239/599, 601; 222/402.1, 402.24

[56] References Cited

U.S. PATENT DOCUMENTS

| | | | |
|---|---|---|---|
| D. 198,356 | 6/1964 | Wahlin | D91/1 |
| 2,621,078 | 12/1952 | Wahlin . | |
| 2,683,627 | 7/1954 | Wahlin . | |
| 2,918,442 | 12/1959 | Gerrard et al. | 260/29.3 |
| 3,647,147 | 3/1972 | Cook | 239/599 |
| 3,659,787 | 5/1972 | Ito | 239/599 |
| 4,097,000 | 6/1978 | Derr | 239/599 |

OTHER PUBLICATIONS

Cover page and pp. 29–30 from Newman-Green, Inc., "Aerosol Valves, Sprayheads, & Accessories" Catalog.

Cover page and p. 10 from Aerosol Research Company Catalog.

Cover page and page entitled "Pacesetter" from Sprayon Products Division of Sherman-Williams Co., Custom Filling Capability Brochure.

*Primary Examiner*—Andres Kashnikow

*Attorney, Agent, or Firm*—Cruzan Alexander; Donald M. Sell; David W. Anderson

[57] ABSTRACT

Aerosol spray heads which provide a fan spray pattern for cohesive polymer solutions at high aerosol solids levels. The orifice of the spray heads is elongate in shape and generally aligned with and centered in an elongate groove in the exit face of the spray tip.

22 Claims, 8 Drawing Figures

AEROSAL FAN SPRAY HEAD

TECHNICAL FIELD

This invention relates to aerosol spray heads which provide a fan spray pattern. This invention also relates to aerosol containers having a fan spray head. In addition, this invention relates to aerosol containers having a fan spray head adapted to dispense cohesive polymer solutions.

BACKGROUND ART

Many coating and adhesive materials are most conveniently applied by spraying. For small volume applications, it is often convenient to apply a coating or adhesive material using an aerosol container equipped with a fan spray head producing an elongated spray pattern. "Fan spray", as used herein, will refer to spray patterns which have a major diameter and a minor diameter, with the major diameter being at least twice as long as the minor diameter, as measured at a distance of about 150 to 200 mm from the spray head orifice. Fan spray patterns are therefore different from conventional, "circular" patterns, which, as used herein, will refer to patterns in which the major diameter is less than or equal to twice the minor diameter at a distance of about 150 to 200 mm from the spray head orifice. Various fan spray heads for aerosol containers are or have been commercially available, e.g., models 181, 196, and 197 series fan spray heads from Newman-Green Inc., Model RAR-53 fan spray heads from Aerosol Research Co., model "Danvern Fanspray" heads from Sprayon Products division of Sherman-Williams Co., and the Model 21-468004 Fan Spray Head from Precision Valve Corp.

Some dispersions of elastomers (e.g., cross-linked nitrile rubbers, crosslinked butyl rubbers, and neoprene graft copolymers) have been sold in aerosol containers equipped with fan spray heads of the type described above. In contrast to dispersions of elastomers, solutions of elastomers are very difficult to spray from an aerosol container, either in a fan spray or conventional pattern, particularly when the polymer structure of the elastomer has extensive chain entanglement or high solution viscosity. In general, if a polymer has a number average molecular weight above about 10,000 and generates a solution having non-Newtonian viscoelastic properties, it will be difficult to spray from an aerosol container. Such difficult to spray polymers (which hereafter will be referred to generally as "cohesive polymer solutions") have not been made commercially available in aerosol containers, because it has not been possible to obtain acceptable spray patterns from aerosol containers containing such cohesive polymer solutions at levels greater than a few percent aerosol solids in solution. For example, when a polychloroprene contact adhesive based on "Neoprene AC" (which is commercially available from E. I. duPont de Nemours Co.) is dissolved in a solvent such as methylene chloride and loaded in an aerosol spray container pressurized with a propellant such as dimethyl ether to a standard pressure of 0.17 megapascals, and equipped with a Newman-Green Inc. Model R-10-123 can valve and a Model 197-27-12 fan spray head, an approximately 50 millimeter wide fan spray is obtained at aerosol solids levels below about 4.4 weight percent, and a "squirt" or "firehose" type discharge is obtained at higher aerosol solids levels. A 4.4 weight percent aerosol solids solution of "Neoprene AC"-based polychloroprene contact adhesive packaged in a standard 475 $cm^3$ aerosol can would provide only about 22.0 grams of solid adhesive product, an amount sufficient to cover two surfaces of an area of only about 3.7 $m^2$. Such a small amount of product would be commercially unacceptable, as a consumer would primarily be paying for the container and would quickly exhaust the container contents. For these reasons, cohesive polymer solutions have never been successfully marketed in aerosol containers. Instead, where possible, they are crosslinked and sold as aerosol dispersions. Otherwise, the polymer generally is sold in containers such as cans, tubes, and bottles, and is not applied using the convenience of aerosol spray.

Sprayed materials are often applied using aerosol or airless spray heads. Many varieties of aerosol spray head configurations have been used to provide fan spray or conventional spray patterns. These aerosol spray heads have typically operated under a driving force of between about 0.14 and 0.83 megapascals, as measured at 25° C. Many spray head configurations have been used for airless spray applications, under operating pressures which are generally between about 0.1 and 31 megapascals, depending upon the material to be sprayed. For example, adhesives are generally sprayed at greater than about 6.9 megapascals when using airless spray equipment. Among the spray heads used for airless spray applications are spray heads having an elongated orifice recessed in an elongate groove or channel, such as those described in U.S. Pat. Nos. 2,621,078, 2,683,627, 3,647,147, 4,097,000, and Des. 198,356. Such airless spray heads have been used to spray materials such as insecticides, paints, adhesives, and the like. However, orifices of the type disclosed in these patents have not been previously reported for use on aerosol containers, and the teachings of these patents do not indicate that the orifice configuration of the spray heads described therein might have utility for use in spray heads for aerosol containers filled with cohesive polymer solutions.

DISCLOSURE OF INVENTION

The present invention provides, in one aspect, an aerosol spray head adapted to be slidably and sealably mounted in the can valve of an aerosol container, said spray head comprising:

(a) a generally cylindrical inlet stem having inlet and outlet end portions, a central passageway between said inlet and outlet end portions, and at least one fluid metering passage through the side wall of said stem proximate said inlet end portion and communicating with said central passageway; and (b) a nozzle portion attached to said outlet end portion of said stem, said nozzle portion having an elongate groove which defines a terminal surface for said nozzle portion, said groove having a major axis, said nozzle portion further having an elongate chamber extending generally transverse to said stem with a central axis, an outlet end, and an inlet end communicating with said central passageway, and an orifice communicating with said outlet end of said elongate chamber and opening through said terminal surface, said orifice forming an elongate intersection with said terminal surface as viewed along said central axis, being generally centered in said groove, and having a major axis which is generally aligned with said major axis of said groove, wherein said major axis of said groove is longer than said major axis of said orifice.

Also, the present invention provides aerosol containers equipped with such aerosol spray heads.

BRIEF DESCRIPTION OF DRAWING

In the accompanying drawing.

DETAILED DESCRIPTION

Figure 1:
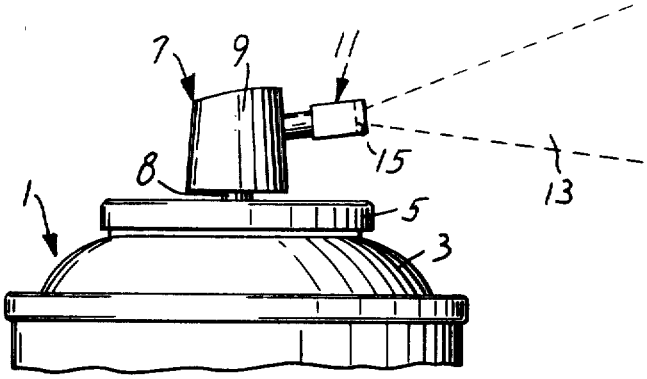
FIG. 1 is a side view of an aerosol container equipped with a spray head of this invention.

Referring now to the drawing, in FIG. 1 is shown aerosol container 1. In the outlet of the neck of can 3 is inserted can valve 5 and spray head 7. Spray head 7 has an inlet stem 8 through which the can contents flow when push button portion 9 is depressed. Inlet stem 8 can be an integral part of the spray head (thereby providing a spray head with a male inlet which is insertable into a female can valve, with the outlet end of the inlet stem being fixed to the nozzle portion of the spray head), or, if desired, can be incorporated into the can valve (thereby providing a spray head with a female inlet which can be mated with a male can valve, with the outlet end of the inlet stem being frictionally attached to the nozzle portion of the spray head). The can contents flow through spray tip or nozzle portion 11 and exit as spray 13. Spray tip 11 can be removable from the remainder of spray head 7 or, if desired, can be an integral part of the spray head. Shown in phantom view is groove 15 in the end face of tip 11.

Figure 2:
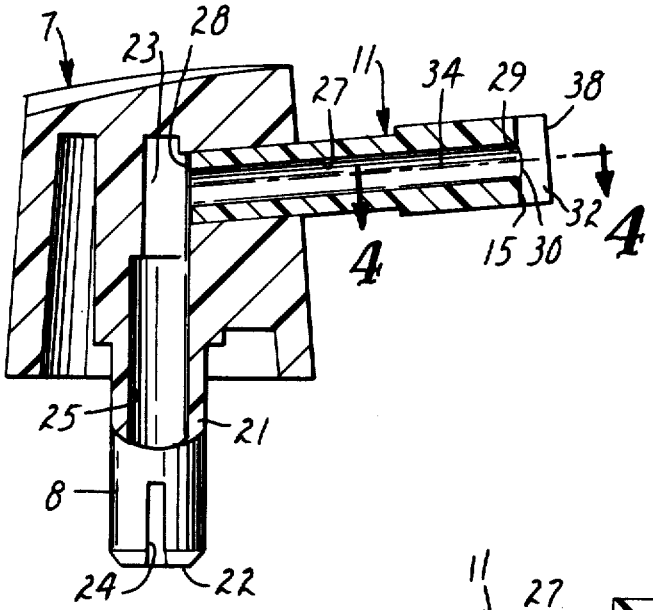
FIG. 2 is a sectional view of the spray head of FIG. 1.

Referring now to FIG. 2, spray head 7 is shown partially in section. Inlet stem 8 has a generally cylindrical wall 21 having an inlet end portion 22 and an outlet end portion 23. When the spray head push button is depressed into the can valve, fluid enters inlet stem 8 through fluid metering passage 24 cut in side wall 21 and is carried via central passageway 25 toward the outlet end portion of inlet stem 8. Fluid then travels into spray tip 11, entering chamber 27 through inlet end 28. The fluid next travels toward outlet end 29 of chamber 27, and exits spray tip 11 via orifice 30. Upon leaving orifice 30, the fluid passes between the side walls of groove 15, one wall of which is shown as 32 in FIG. 2. Chamber 27 is elongated in the direction of central axis 34, and is orientated generally transverse to the central axis of passageway 25 of inlet stem 8. In FIG. 2, the included angle between central axis 34 of chamber 27 and the central axis of passageway 25 of inlet stem 8 is approximately 100°.

Figure 3:
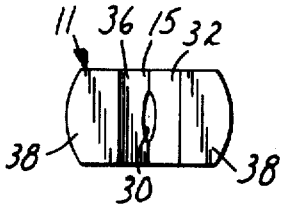
FIG. 3 is an end view of the orifice and groove formed in the end of the spray tip portion of the spray head of FIGS. 1 and 2.

Referring now to FIG. 3, side walls 32 and 36 of groove 15 form a terminal surface for spray tip 11. Groove 15 is flanked by flat lands 38. The bottom of groove 15 defines a major axis for groove 15. Shown in this view, which is normal to axis 34 of chamber 27, is the elongate intersection of orifice 30 with groove 15. Orifice 30 is generally centered in and aligned with the major axis of groove 15.

Figure 4:
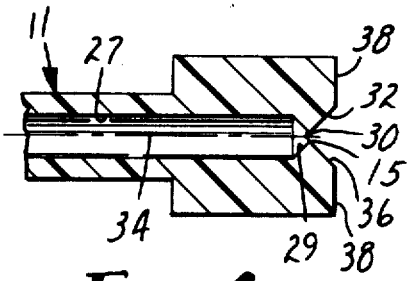
FIG. 4 is a top sectional view of a part of the spray head of FIGS. 1-3, taken along the line 4—4 of FIG. 2.

Referring now to FIG. 4, there is shown a partial sectional view of spray tip 11 taken along line 4—4 of FIG. 2. Outlet end portion 29 of chamber 27 can be seen to converge inward toward central axis 34 of chamber 27. In FIG. 4, side walls 32 and 36 of groove 15 are disposed at approximately a 90° included angle. Lands 38 are approximately coplanar.

Figure 5:
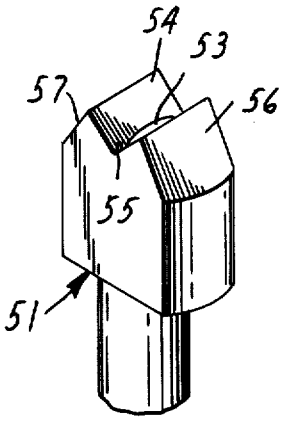
FIG. 5 is a perspective view of another embodiment of the spray tip portion of FIG. 3.

Referring now to FIG. 5, there is shown another embodiment of the spray tip portion of the spray heads of this invention. Spray tip portion 51 has elongate orifice 53 centered in a groove defined by side walls 54 and 55. The groove is flanked by lands 56 and 57. Unlike the lands 38 in the tip portion of the spray head of FIGS. 1-4, lands 56 and 57 are not coplanar, but rather are skewed.

Figure 6:
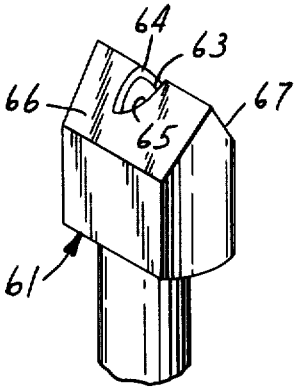
FIG. 6 is a perspective view of an additional embodiment of the spray tip portion of the nozzle of FIG. 3.

Referring now to FIG. 6, there is shown another embodiment of the tip portion of the spray heads of this invention. Spray tip portion 61 has an elongate orifice 63 which is centered in and aligned with a groove defined by side walls 64 and 65. This groove is flanked by lands 66 and 67. Lands 66 and 67 are skewed relative to one another and their line of intersection is transverse to the major access of the elongate orifice 63.

Figure 7:
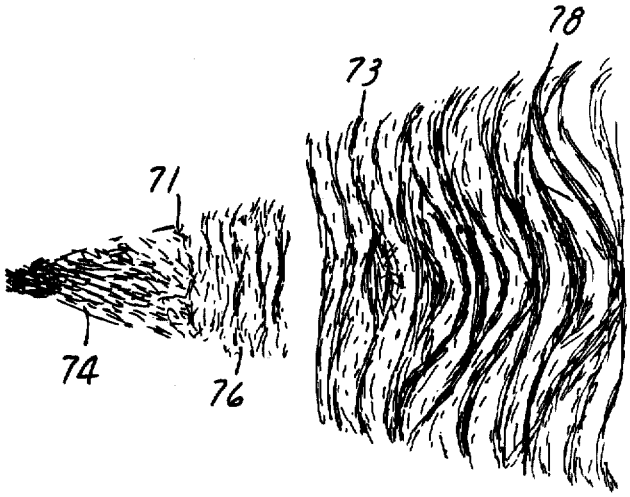
FIG. 7 is a side view of two regions of the spray pattern produced by spraying a solution of polychloroprene contact adhesive through a spray head of this invention.

Referring now to FIG. 7, there is shown a side view of two portions of a representative spray pattern produced by a spray head of this invention. Initial portion 71 represents the appearance of sprayed fluid as it travels the first few millimeters from the spray orifice. Spray portion 73 represents a pattern appearance after the sprayed fluid has traveled several centimeters from the orifice. As the sprayed fluid initially exits the orifice, the propellant (and solvent, if present) flash off, and the spray pattern appears as a disintegrating sheet 74. Upon traveling further, the sprayed fluid appears as ribbons or threads 76. After traveling further into region 73, the sprayed fluid forms distinct threads 78 which are somewhat sinusoidal in appearance when viewed from the perspective of FIG. 7.

Figure 8:
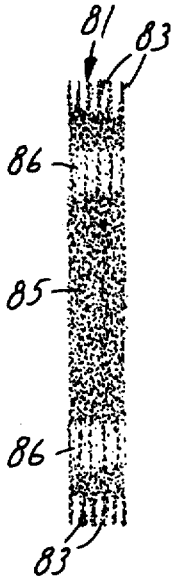
FIG. 8 is an end view of the spray pattern of FIG. 7 after such spray pattern has impacted a planar surface.

Referring now to FIG. 8, the spray pattern 81 is elongated with fairly sharply defined edges or tails 83 and a broad center 85. Lighter areas 86 are sometimes present, and these represent areas in which less sprayed material is deposited than at the edges 83 and center 85.

The spray heads of this invention are ordinarily made of plastic, but can be made from other materials if desired. They are molded using methods well-known to those skilled in the art. Spray heads of this invention can, if desired, be made by enlarging the groove which intersects the circular orifice in the spray tip of a Newman-Green Inc. model 181 series fan spray head, or by cutting a groove in the exit face of spray heads having a converging mixing chamber in the region just prior to the orifice, such as the Newman-Green model 196 and 197 series fan spray heads, thereby providing spray heads with an enlarged, elongated orifice generally centered in an elongate groove, and having the configuration of the spray heads of this invention. When modifying the spray tip of a Newman-Green Inc. model 181 series fan spray head, it is preferable to insert the modified spray tip into a suitable extension tube, and insert the extension tube into the spray button portion of a model 197 fan spray head from which the standard spray tip has been removed. A suitable extension tube can be prepared by inserting the modified spray tip into a piece of 2.8175 mm I.D. plastic tubing (Piece A), placing the free end of Piece A over a piece of 2.8175 O.D. plastic tubing (Piece B), and inserting the free end of Piece B into the spray button portion of the model 197 fan spray head. Spray heads of this invention can also be made by fitting airless spray nozzles having an elongated orifice centered in and aligned with a groove in the exit face of the nozzle (such as the Spraying Systems, Inc. model 4002, 4003, 4005, 4008, 8003, 11003, and 25015 spray nozzles) to an inlet stem which is generally transversely oriented with respect to the direction of flow of material through the airless spray nozzle, the stem being adapted to be slidably and sealably inserted in a can valve of an aerosol container.

Either male or female can valves may be used in this invention, with female can valves being preferred. Metal containers are ordinarily used, but other aerosol containers, such as glass bottles, plastic bottles, and the like can also be used with the spray heads of this invention if desired. Standard container filling practices, propellants, and container pressures are employed.

The inlet stem of the spray heads of this invention is equipped with at least one fluid metering passage which admits the fluid to be sprayed into the interior of the spray head when the spray head is pressed into the can valve a sufficient distance to open the valve. The fluid metering passage is preferably in the form of a slot with a rectangular cross section, the slot being cut into the inlet end of the inlet stem through the stem side wall. Preferred cross sectional dimensions of the fluid metering passage are 0.2 by 1.5 millimeters up to about 1 by 3 millimeters. Larger fluid metering passage cross sectional areas permit greater flow of material into the spray head and promote higher shear rates at the spray head orifice, thereby aiding break up of the sprayed fluid as it leaves the orifice and increased spray pattern width. Such large fluid metering passages can be used where desired, consonant with maintaining adequate control of the sprayed fluid by the user. The fluid metering passage need not be rectangular in cross section, but can be round, triangular, or have other shapes if desired. Also, the fluid metering passage need not be located adjacent the inlet end of the inlet stem, but can, if desired, be displaced toward the outlet end of the stem, provided that a suitable can valve is employed having sufficient travel to permit the contents of the aerosol container to enter the fluid metering passage when the spray head is depressed.

After fluid enters the inlet stem, the fluid travels along the central passageway toward the outlet end of the inlet stem. This central passageway is ordinarily circular in cross section, but can have other shapes if desired. The central passageway can taper, expand, or remain uniform in diameter along its length. Preferred stem inside diameters are about 1 to 3 mm.

After exiting the outlet end of the inlet stem, the fluid enters the inlet end of the elongated chamber of the nozzle portion of the spray head. This elongated chamber is disposed transverse with respect to the inlet stem, preferably at an included angle between about 90° and 120° with respect to the inlet stem. The elongated chamber has a central axis in the direction of elongation, which axis is ordinarily an axis of symmetry. The elongated chamber is usually circular in cross section, but can have other shapes if desired. Preferably, the elongated chamber has a reduced cross sectional area proximate its outlet end, in order to impart shear forces to fluid in the vicinity of the orifice. The outlet end of the elongated chamber can be non-circular in cross section (e.g., elliptical), substantially frustoconical in shape proximate the orifice, or, if desired, can have other shapes such as a paraboloidal or hemispherical shape proximate the orifice. Additional shear forces will be imparted to the fluid in the vicinity of the outlet end of the elongated chamber if the elongated chamber is parabolic in side section and elliptical in cross section in the manner described in U.S. Pat. No. 4,097,000. However, this latter shape is somewhat difficult to machine, and very satisfactory results are obtained if the outlet end of the elongated chamber is frustoconical in shape. Preferred elongated chamber mean diameters taken normal to the central axis of the elongated chamber are about 0.3 to 5 mm. Preferred elongated chamber lengths along the central axis of the chamber are about 3 to 15 mm.

The orifice through which sprayed fluids leave the spray heads of this invention is defined by the intersection of the outlet end of the elongated chamber and the groove in terminal surface of the spray head. The orifice can have a variety of shapes, with the only requirement being that the orifice is elongated in appearance when viewed along the central axis of the elongated chamber (e.g., as viewed from outside the spray head through the orifice toward the inlet end of the elongated chamber). When so viewed, the orifice has a major and a minor diameter. For spray heads of this invention in which the outlet end of the elongated chamber is frusto-conical in shape, and the groove in the spray head is a V-shaped channel, the shape of the orifice corresponds to two skewed, intersecting parabolas, and when viewed along the central axis of the elongated chamber looks like a partially flattened circle. This orifice configuration will be obtained if the spray tip of a Newman-Green Inc. series 181 fan spray head is modified as described above. The orifice can have other shapes if desired. For example, when viewed along the central axis of the elongated chamber, the orifice can be rectangular (an orifice configuration which will be obtained when a v-shaped groove is cut across the short dimension of the exit face of the spray tip of a Newman-Green series 197 fan spray head), diamond-shaped (an orifice configuration which will be obtained when a v-shaped groove is cut across the long dimension of the exit face of the spray tip of a Newman-Green series 197 fan spray head), elliptical, or other elongated shape. Preferred orifice dimensions range between about 0.4 to 1.6 mm along the minor diameter (with about 0.8 to 0.9 mm being most preferred) and about 0.9 to 2.5 mm along the major diameter (with about 1.4 to 1.6 mm being most preferred).

The groove defines a terminal surface for the nozzle portion of the spray heads of this invention, and can have a variety of shapes, with the only requirements being that the groove is generally aligned with the orifice (i.e., the groove is elongate in the general direction of the major axis of the orifice) and the long axis of the groove is longer than the length of the major axis of the orifice. In a preferred embodiment of this invention, the groove is a V-shaped channel, having sides disposed at an included angle between about 40° and 120° and most preferably at an included angle of about 80° to 100°. The elongated orifice lies generally centered in and generally aligned with the long axis of the groove. The groove can have other shapes if desired. For example, the groove can be a U-shaped channel such as the channels shown in U.S. Pat. No. 2,621,078, or the groove can be square, rectangular, or trapezoidal in cross section.

Because the long axis of the groove is longer than the length of the major axis of the orifice, air can enter the ends of the groove and merge with the exiting stream of sprayed fluid, thereby facilitating breakup of the sprayed fluid. The ends of the groove can be closed, if desired, but preferably they are open, and can be further cut away in the manner described in U.S. Pat. No. 2,683,627 if desired.

In a preferred embodiment of the invention, the groove is bordered at its ends or flanked on its sides by lands. These lands are ordinarily planar, and can be coplanar with one another. However, the lands can be convex, concave, or combinations thereof, and can have a smooth or rough surface. When spray heads of this invention are formed by modifying the Newman-Green Models 181, 196, or 197 Spray Heads described above, the lands preferably flank the groove, have smooth planar surfaces, and are disposed in the same plane (i.e., they are coplanar).

Fluids which can be sprayed with the spray head of this invention include paints, coatings, sealants, and adhesives. Such materials can be in the form of dispersions or solutions. The spray heads of the invention are particularly well suited to the spray of cohesive polymer solutions, as such solutions of polymers are very difficult to spray using conventional aerosol fan spray heads. Solvents which can be used to dissolve such polymers include water, aliphatic and aromatic hydrocarbons such as methylene chloride, hexane, heptane, toluene, and cyclohexane, ketones such as methyl ethyl ketone and acetone, alcohols such as ethanol, esters such as ethyl acetate, and the like. Adjuvants such as dyes, pigments, fillers, retarders, accelerators, plasticizers, antioxidants, ultraviolet absorbers, crosslinking agents, surfactants, tackifiers, soak-in aids, inhibitors, leveling and flow control agents, indicators, and the like, or mixtures thereof, can also be included in formulations to be sprayed with the spray heads of this invention.

The aerosol containers of this invention are ordinarily filled with a propellant such as dimethyl ether, propane, isobutane, carbon dioxide, nitrous oxide, or chlorofluorocarbon, or mixtures thereof, and the like. The container contents are pressurized by adding propellant until the container pressure reaches the desired level.

When solutions are placed in the aerosol containers of this invention, aerosol solids levels in excess of 30 percent by weight can be obtained with some polymers. Above some level of aerosol solids in solution a sprayable material will no longer exit the spray heads of this invention in the desired fan spray pattern, but will instead exit in a "squirt" stream. The percent aerosol solids limit beyond which the fan spray pattern deteriorates will depend upon the type of materials to be sprayed, solvent, propellant, temperature, container pressure, and tip geometry. Such limit is most readily determined empirically.

The level of total aerosol solids at which a cohesive polymer solution can be sprayed in a fan spray pattern through the spray heads of this invention is much higher than the level of total aerosol solids at which a cohesive polymer solution can be sprayed in a fan spray pattern through aerosol fan spray heads of the prior art. Several comparisons between the fan spray heads of this invention and fan spray heads of the prior art are contained in the examples which follow. These examples are offered to aid understanding of the present invention and are not be to be construed as limiting the scope thereof.

EXAMPLE 1

The spray tip insert from a Newman-Green Model 181-27-1420 fan spray head was modified by cutting a V-shaped groove normal to the flow axis through the tip and along the long dimension of the exit face of the tip, bisecting the tip orifice. The circular orifice of the unmodified spray head thereby became elongated in shape, and was defined by the intersection of the V-shaped groove and the frusto-conical outlet end of the elongated chamber within the spray head and adjacent the original orifice. The orifice had a minor diameter of 0.89 mm and a major diameter of 1.52 mm. The two sides of the V-shaped groove were cut at about a 45° angle to the plane of the exit face of the spray tip, thereby forming a groove with about a 90° included angle between the groove walls. The V-shaped groove extended the entire length of the exit face of the spray tip, and had a depth of 0.99 mm.

The modified tip was inserted into a 6.9 mm long piece of 2.8175 mm I.D. plastic tubing, the free end of which was inserted into an 8 mm long piece of 2.8175 mm O.D. plastic tubing, the free end of which was in turn inserted into the spray button portion of a Newman-Green Model 197-27-12 actuator from which the original spray tip had been removed. The exit face of the spray tip projected about 10.7 mm beyond the exit face of the spray button. This assembly was mounted on a Newman-Green Model R10-123 can valve.

A solution of polychloroprene contact adhesive in methylene chloride was prepared according to the teachings of U.S. Pat. No. 2,918,442 using the ingredients and amounts shown below in TABLE I.

TABLE I

| Ingredient | Weight, grams |
|---|---|
| 60 to 80 Mooney viscosity polychloroprene copolymer[1] | 6.8 |
| t-Butyl phenolic resin[2] | 3.4 |
| Magnesium oxide[3] | 1.4 |
| Water | 0.07 |
| Methylene chloride | 68.4 |

[1]"Neoprene AC", commercially available from E. I. du Pont de Nemours Co., milled 5 minutes on a two-roll mill.
[2]"CKR 1634", commercially available from Union Carbide Co.
[3]"Maglite A", commercially available from Merck Chemical Co.

This formulation was placed in a Model 202×406 aerosol can (commercially available from American Can Co.) and capped with the above-identified can valve. The can was filled with 24 g dimethyl ether through the can valve (thereby providing an 11.1 percent aerosol solids level in the container), and the spray was then placed on the can valve. The pressure inside the aerosol can reached about 0.17 magapascals. The spray head was held at a distance of 150 to 200 millimeters from a foil sheet, and the spray head depressed. A lacey, elongated pattern having a major dimension of approximately 90 to 100 millimeters was obtained on the foil sheet.

The above procedure was repeated at aerosol solids levels of 8.1 percent, 6.8 percent, 4.9 percent, and 4.4 percent, by varying the amount of solvent and propellant while holding constant the ratio of aerosol solids plus solvent to propellant. In each case, an elongated, lacey spray pattern was obtained, with longer patterns being obtained at lower solids levels.

In a comparison run, an unmodified Newman-Green Model 181-27-1420 fan spray head was employed with the above-described can valve, aerosol can, and adhesive formulations. The model 181 fan spray head provided only a "squirt" type discharge at 11.1, 8.1, 6.8, 4.9, and 4.4 percent aerosol solids.

In an additional comparison run, an unmodified Newman-Green Model 197-27-12 fan spray actuator was employed using the above-described can valve, aerosol can, and adhesive formulations. The spray tip of the Model 197 spray head has a rectangular orifice, and no groove is present in the exit surface of the spray tip. Using the Model 197 spray head, a "squirt" type discharge was obtained at solids levels of 11.1, 8.1, 6.8, and 4.9 percent aerosol solids. A 50 mm long fan spray pattern was obtained at 4.4 percent aerosol solids.

This example shows that a spray head of this invention provided a fan spray pattern for a soluble polychloroprene adhesive formulation at an aerosol solids level as high as 11.1 percent. An 11.1 percent aerosol solids formulation of the above adhesive would provide 55.4 g of adhesive solids in a standard 475 $cm^3$ aerosol container at a pressure of 0.17 MPa, enough adhesive to cover two surfaces of an area of 9.23 $m^2$. One of two commercially available aerosol fan spray heads provided a fan spray pattern at levels no higher than 4.4 percent aerosol solids using the same adhesive formulation, and the other commercially available aerosol fan spray head provided only a "squirt" type discharge at all tested levels. A 4.4 percent aerosol solids formulation of the above adhesive would provide 22.0 g of adhesive solids in a standard 475 $cm^3$ aerosol container at a pressure of 0.17 MPa, an amount of adhesive which is only 39.6 percent (and would cover only 39.6% of the area) of the 11.1% aerosol solids formulation described above.

EXAMPLES 2-17

Using the method of Example 1, a series of adhesive, coating, and sealant materials was formulated and sprayed through the modified Newman-Green Model 181 fan spray tip (mounted on the spray button of a Newman-Green Model 197 fan spray head), and through an unmodified Newman-Green Model 197 fan spray head. The polymers which were sprayed were formulated as follows:

Polychloroprene Contact Adhesive A

Formulations were prepared from the polychloroprene adhesive of Example 1, but a mixture of propane and isobutane was used as propellant in place of dimethyl ether. The aerosol solids level was altered as in Example 1. These formulations were evaluated at aerosol solids levels of 4.8, 5.4, 6.2, 7.1, 8.5, 10, 10.5, 11, 11.6, and 12.2 percent. The 4.8 percent solids formulation contained 3.4 grams polychloroprene copolymer, 1.7 grams t-butyl phenolic resin, 0.7 grams magnesium oxide, and 0.035 grams water (these amounts being one half of the amounts used in Example 1), as well as 86.7 grams methylene chloride, 10.9 grams propane, and 16.3 grams isobutane. The 10.5 percent aerosol solids formulation contained 6.8 grams neoprene polymer, 3.4 grams t-butyl phenolic resin, 1.4 grams magnesium oxide, and 0.07 grams water (these amounts being the same as those set forth in Example 1), as well as 73.4 grams methylene chloride, 10 grams of propane, and 15 grams of isobutane.

Polychloroprene Contact Adhesive B

Formulations were prepared from a base stock containing 4.8 grams of 100 to 130 Mooney viscosity polychloroprene polymer ("Neoprene WHV-A", commercially available from E. I. du Pont de Nemours Co., milled 5 minutes on a two-roll mill), 2.4 grams t-butyl phenolic resin, 0.97 grams magnesium oxide, and 0.05 grams water, with methylene chloride as solvent and dimethyl ether as propellant. The aerosol solids level was adjusted as in Example 1. These formulations were evaluated at aerosol solids levels of 2.3, 2.7, 3.1, 6.4, 7.2, 7.7, and 8.6 percent. The 2.3 percent aerosol solids formulation contained 231.7 grams methylene chloride and 111.2 grams dimethyl ether. The 6.4 percent aerosol solids formulation contained 81.7 grams methylene chloride and 39.2 grams dimethyl ether.

Nitrile Adhesive A

Formulations were prepared from a base stock containing non-crosslinked nitrile polymer ("Hycar 1092-30", commercially available from B. F. Goodrich Co., milled 5 minutes on a two-roll mill), terpene phenolic resin ("SP 560", commercially available from Schenectady Chemicals, Inc.), methyl ethyl ketone as solvent, and dimethyl ether as propellant. The aerosol solids level in each formulation was adjusted by varying the amount of solvent and propellant while maintaining a constant ratio of solvent to propellant. These formulations were evaluated at aerosol solids levels of 9, 10, 14, and 15 percent. The 9 percent aerosol solids formulation contained 5.1 grams nitrile polymer, 0.5 grams terpene phenolic resin, 45.4 grams solvent and 32 grams propellant. The 15 percent aerosol solids formulation contained 8.5 grams nitrile polymer, 4.2 grams terpene phenolic resin, 42.3 grams solvent, and 30 grams propellant.

Nitrile Adhesive B

Formulations were prepared from a base stock containing non-crosslinked nitrile polymer ("Hycar 1092-50", commercially available from B. F. Goodrich Co., milled 5 minutes on a two-roll mill), terpene phenolic resin ("SP 560", commercially available from Schenectady Chemicals, Inc.), methyl ethyl ketone as solvent, and dimethyl ether as propellant. The aerosol solids level in each formulation was adjusted by varying the amount of solvent and propellant while maintaining a constant ratio of solvent to propellant. These formulations were evaluated at aerosol solids levels of 7, 8, 9, 10, 13, and 14 percent. The 7 percent aerosol solids formulation contained 4.0 grams nitrile polymer, 2.0 grams terpene phenolic resin, 46.3 grams solvent, and 32.7 grams propellant. The 13 percent aerosol solids formulation contained 7.4 grams nitrile polymer, 3.7 grams terpene phenolic resin, 43.2 grams solvent, and 30.7 grams propellant.

Nitrile Adhesive C

Formulations were prepared from a base stock containing non-crosslinked nitrile polymer ("Hycar 1092-80", commercially available from B. F. Goodrich Co., milled 5 minutes on a two-roll mill), terpene phenolic resin ("SP 560", commercially available from Schenectady Chemicals, Inc.), methyl ethyl ketone as solvent, and dimethyl ether as propellant. The aerosol solids level in each formulation was adjusted by varying the amount of solvent and propellant while maintaining a constant ratio of solvent to propellant. These formulations were evaluated at aerosol solids levels of 5, 6, 10 and 12 percent. The 5 percent aerosol solids formulation contained 2.8 grams nitrile polymer, 1.4 grams terpene phenolic resin, 47.3 grams solvent, and 33.5 grams propellant. The 10 percent aerosol solids formulation contained 5.7 grams nitrile polymer, 2.8 grams terpene phenolic resin, 44.8 grams solvent, and 31.7 grams propellant.

Natural Rubber Adhesive

Formulations were prepared from a base stock containing pale crepe rubber, tall oil rosin (having an acid number of 161 and a softening point of 83° C. as measured using the ball and ring method), methylene chloride as solvent, and dimethyl ether as propellant. The aerosol solids level in each formulation was adjusted by varying the amount of solvent and propellant while maintaining a constant ratio of solvent to propellant. These formulations were evaluated at aerosol solids levels of 6.5, 7, 8.5, 10, 11.8, 12.9, 15.1, 18.2, and 22.9 percent. The 6.5 percent aerosol solids formulation contained 5 grams rubber, 5 grams tall oil rosin, 70 grams solvent and 74 grams propellant. The 15.1 percent aerosol solids formulation contained 10 grams rubber, 10 grams tall oil rosin, 50 grams solvent and 62.5 grams propellant.

Acrylic Resin Coating

Formulations were prepared from a base stock containing 50 grams of a 40 percent solution of acrylic resin in methyl ethyl ketone ("Acryloid A-101", commercially available from Rohm and Haas Co.), sufficient additional methyl ethyl ketone to provide a desired aerosol solids level, and dimethyl ether as propellant. The ratio of weight of dimethyl ether to total weight of acrylic polymer and methyl ethyl ketone was maintained at a constant value. These formulations were evaluated at aerosol solids levels of 14.3, 15, 15.9, 16.8, 17.9, 19, 20.4, 22, 23.8, 26, and 28.6 percent. The 14.3 percent aerosol solids formulation contained a total of 80 grams methyl ethyl ketone and 40 grams dimethyl ether. The 20.4 percent aerosol solids formulation contained a total of 50 grams methyl ethyl ketone and 28 grams dimethyl ether.

Butyl Rubber Adhesive

Formulations were prepared from a base stock containing 3.75 grams butyl rubber ("Bucar 5214", commercially available from CITCO Corp.), 3.75 grams of adhesion promoter ("Stabelite Ester No. 10", commercially available from Hercules Inc.), toluene as solvent and dimethyl ether as propellant. The aerosol solids level in each formulation was adjusted by varying the amount of solvent and propellant, while maintaining a constant ratio of aerosol solids plus solvent to propellant. These formulations were evaluated at aerosol solids levels of 4.7, 4.9, 5.2, 5.5, 5.9, 6.3, 6.4, 6.6, 6.9, and 7.6 percent. The 4.7 percent aerosol solids formulation contained 92.5 grams toluene and 60 grams dimethyl ether. The 6.6 percent aerosol solids formulation contained 62.5 grams toluene and 42 grams dimethyl ether.

Non-crosslinked SBR Adhesive

Formulations were prepared from a base stock containing non-crosslinked SBR polymer ("Amsyn 1551", commercially available from American Synthetic Rubber Corp.), adhesion promoter ("Stabelite Ester No. 10", commercially available from Hercules Inc.), methylene chloride as solvent, and dimethyl ether as propellant. The aerosol solids level in each formulation was adjusted by varying the amount of solvent and propellant while maintaining a constant ratio of solvent to propellant. These formulations were evaluated at aerosol solids levels of 5.6, 6.2, 6.9, 7.9, 9.3, 10.4, 11.9, and 13.9 percent. The 5.6 percent aerosol solids formulation contained 2.5 grams non-crosslinked SBR polymer, 2.5 grams adhesion promoter, 45 grams solvent, and 40 grams propellant. The 10.4 percent aerosol solids formulation contained 3.75 grams non-crosslinked SBR polymer, 3.75 grams adhesion promoter, 32.5 grams solvent and 32 grams propellant.

Crosslinked SBR Adhesive

Formulations were prepared from a base stock containing 15.1 grams crosslinked SBR polymer ("Polysar S1018", commercially available from Polysar Inc., having a gel content of approximately 81 percent, containing approximately 23.5 percent bound styrene, milled 4 passes through a two-roll mill), 11.4 grams each of two alpha-pinene resins ("Piccolyte A125", and "Piccolyte A135", commercially available from Hercules Inc.), a mixture of hexane and cyclohexane as solvents, and a mixture of propane and isobutane as propellants. The aerosol solids level in each formulation was altered by varying the amount of solvent mixture and propellant mixture while maintaining a constant ratio of total solvent to total propellant. These formulations were evaluated at aerosol solids levels of 27.5, 31, and 38.5 percent. The 27.5 percent aerosol solids formulation contained 51.9 grams hexane, 11.2 cyclohexane, 16.5 grams propane, and 20.8 grams isobutane. The 31 percent aerosol solids formulation contained 41.9 grams hexane, 11.2 grams cyclohexane, 13.9 grams propane, and 17.6 grams isobutane. The 38.5 percent aerosol solids formulation contained 26.9 grams hexane, 11.2 grams cyclohexane, 10 grams propane, and 12.8 grams isobutane.

Block Copolymer Adhesive

Formulations were prepared from a base stock containing 7.5 grams butadiene-styrene copolymer ("Kraton 1101", commercially available from Shell Chemical Co.), 7.5 grams alpha-pinene resin ("Piccolyte A125", commercially available from Hercules Inc.), 35 grams methylene chloride as solvent, and dimethyl ether as propellant. The aerosol solids level in each formulation was altered by varying the amount of propellant. These formulations were evaluated at aerosol solids levels of 18.6, 21.4, and 25 percent. The 18.6 percent aerosol solids formulation contained 30 grams propellant. The 25 percent aerosol solids formulation contained 10 grams propellant.

Heat Activatable Adhesive

Formulations were prepared from a base stock containing an aliphatic segmented polyester (prepared according to Example 24 of U.S. Pat. No. 4,059,715), 1.36 grams pentaerythritol ester of wood rosin ("Pentalyn A", commercially available from Hercules Inc.), 35 grams methylene chloride as solvent, and dimethyl ether as propellant. The aerosol solids levels in each formulation was altered by varying the amount of propellant. These formulations were evaluated at aerosol solids levels of 16.7, 18.75, and 21.4 percent. The 16.7 percent aerosol solids formulation contained 40 grams of propellant. The 21.4 percent aerosol solids formulation contained 20 grams of propellant.

Rubberized Undercoating

Formulations were prepared from a base stock containing 4.1 grams polychloroprene copolymer ("Neoprene AC", commercially available from E. I. du Pont de Numours Co., milled 5 minutes on a two-roll mill), 5.75 grams alpha-pinene resin ("Piccolyte A125", commercially available from Hercules Inc.), 4.1 grams asphalt ("Petrolastic Asphalt No. 3", commercially available from Standard Oil Co.), 10.26 grams talc ("Beaverwhite 325", commercially available from Cypress Industrial Minerals Co.), 0.78 grams carbon black, methylene chloride as solvent, and dimethyl ether as propellant. The aerosol solids level in each formulation was altered by varying the amount of solvent and propellant while maintaining a constant ratio of aerosol solids plus solvent to propellant. These formulations were evaluated at aerosol solids levels of 13, 14.2, 15.6, 17.4, 19.5, 22.3, 26, and 31.3 percent. The 13 percent aerosol solids formulation contained 95.99 grams methylene chloride and 72 grams dimethyl ether. The 26 percent aerosol solids formulation contained 35.99 grams methylene chloride and 36 grams dimethyl ether.

Protective Coating

Formulations were prepared from a base stock containing 25 grams of a 31 percent solution of polychloroprene/chlorinated natural rubber in aromatic, naphthenic, and ketone solvents ("EC 1706", commercially available from 3M Co.), methylene chloride as solvent, and dimethyl ether as propellant. The aerosol solids level in each formulation was adjusted by varying the amount of solvent and propellant while maintaining a constant ratio of aerosol solids plus solvent to propellant. These formulations were evaluated at aerosol solids levels of 6.6, 7.2, 7.8, 8.6, 9.6, 10.8, 12.3, and 14.4 percent. The 6.6 percent aerosol solids formulation contained 40 grams propellant and 52 grams solvent. The 12.3 percent aerosol solids formulation contained 10 grams propellant and 28 grams solvent.

Urethane Adhesive

Formulations were prepared from a base stock containing 7.5 grams urethane polymer ("Estane 5711", commercially available from B. F. Goodrich Chemical Co.), methyl ethyl ketone as solvent, and dimethyl ether as propellant. The aerosol solids level was adjusted by varying the amount of solvent and propellant. These formulations were evaluated at aerosol solids levels of 7.2, 7.8, 8.5, 10.5, 11.2, 11.9, and 13 percent. The formulation containing 7.2 percent aerosol solids contained 57.5 grams solvent and 39 grams propellant. The formulation containing 8.5 percent aerosol solids contained 47.5 grams solvent and 33 grams propellant.

Vinyl Strip Coating

Formulations were prepared from a base stock containing vinyl chloride-vinyl acetate copolymer ("Vinylite VYHH", commercially available from Union Carbide Co.), dioctyl phthalate as plasticizer, methylene chloride as solvent, and dimethyl ether as propellant. The aerosol solids level in each formulation was adjusted by varying the amount of propellant. These formulations were evaluated at aerosol solids levels of 13.9, 16.7, 18.8, and 21.4 percent. The formulation containing 13.9 percent aerosol solids contained 5.8 grams vinyl chloride-vinyl acetate copolymer, 1.7 grams plasticizer, 22.5 grams solvent and 24 grams propellant. The formulation containing 18.8 percent aerosol solids contained 11.7 grams vinyl acetate copolymer, 3.3 grams plasticizer, 35 grams solvent and 30 grams propellant.

Set out below in TABLE II are the Example No., polymer, and maximum tested aerosol solids level at which a 50 millimeter long spray pattern was observed, for the modified Model 181 fan spray tip used in Example 1 and for the unmodified Model 197 fan spray tip used as a comparison in Example 1.

TABLE II

| Example No. | Polymer | Maximum tested aerosol solids level at which 50 mm. long pattern observed, percent: Modified Model 181 fan spray tip | Unmodified Model 197 fan spray tip |
|---|---|---|---|
| 2 | Polychloroprene Contact Adhesive A | 10.5 | 4.8 |
| 3 | Polychloroprene Contact Adhesive B | 6.4 | 2.3 |
| 4 | Nitrile Adhesive A | 15 | 9 |
| 5 | Nitrile Adhesive B | 13 | 7 |
| 6 | Nitrile Adhesive C | 10 | 5 |
| 7 | Natural Rubber Adhesive | 15.1 | 6.5 |
| 8 | Acrylic Resin Coating | 20.4 | 14.3 |
| 9 | Butyl Rubber Adhesive | 6.6 | 4.7 |
| 10 | Non-crosslinked SBR Adhesive | 10.4 | 5.6 |
| 11 | Crosslinked SBR Adhesive | 38.5 | 27.5 |
| 12 | Block Copolymer Adhesive | 25 | 18.6 |
| 13 | Heat Activatable Adhesive | 21.4 | 16.7 |
| 14 | Rubberized Undercoating | 26 | 13 |
| 15 | Protective Coating | 12.3 | 6.6 |
| 16 | Urethane Adhesive | 8.5 | 7.2 |
| 17 | Vinyl Strip Coating | 18.8 | 13.9 |

These Examples show that a spray head of this invention provided a fan spray pattern at significantly higher aerosol solids levels than a commercially available aerosol fan spray head, when used with a variety of cohesive polymer solutions and several commonly employed solvents and propellants. In some examples, fan spray patterns were obtained with a spray head of this invention at aerosol solids levels greater than twice that obtainable through use of a commercially available aerosol fan spray head.

EXAMPLES 18–21

The spray tips from several Newman-Green Model 181 fan spray head were modified as in Example 1 by cutting V-shaped grooves in the exit face of the spray tip at a variety of groove angles and groove depths. The spray tips were inserted into spray buttons from Newman-Green Model 197 spray heads as in Example 1, and attached to can valves and aerosol cans as in Example 1 filled with the 11.1 percent aerosol solids polychloroprene contact adhesive formulation of Example 1. Using the method of Example 1, spray patterns from these spray heads were evaluated. Set out below in TABLE III are the Example No., included angle between the walls of the V-shaped groove, groove depth, major and minor orifice dimensions, and spray pattern evaluation.

TABLE III

| Example No. | Groove angle, degrees | Groove depth, mm. | Orifice dimensions, mm. | Pattern |
|---|---|---|---|---|
| 18 | 40 | 1.24 | 1.40 × 0.51 | 127 mm wide with tails |
| 19 | 40 | 1.65 | 1.40 × 0.89 | 102 mm wide |
| 20 | 40 | 2.06 | 1.40 × 1.14 | 114 mm wide with tails |
| 21 | 80-90 | 0.99 | 2.52 × 0.89 | 89 mm wide |

EXAMPLES 22-28

Several airless spray tips of the type used for spraying pesticides, adhesives, and paints at high pressures were modified for aerosol use by threading various 6 mm male pipe thread sleeves and airless spray tips (commercially available from Spraying Systems, Inc.) into a 6 mm female pipe thread bushing which had been brazed to the side outlet of an air-chargeable sprayer ("Sur Shot Sprayer", commercially available from Milwaukee Sprayer Co., having a dip tube, an internal 90° angle which carries fluid from the dip tube to the side outlet, and from which the standard outlet orifice was removed). This assembly was charged with the 11.1 percent aerosol solids polychloroprene contact adhesive formulation and dimethyl ether propellant as used in Example 1. Using the method of Example 1, spray patterns from these spray tips were evaluated. Set out below in TABLE IV are the Example No., manufacturer's spray tip part number, included angle between the walls of the V-shaped groove, groove depth, major and minor orifice dimensions, and spray pattern evaluation.

TABLE IV

| Example No. | Spray Tip No. | Groove angle, degrees | Groove depth, mm. | Orifice dimensions, mm. | Pattern |
|---|---|---|---|---|---|
| 22 | 25015 | 120 | 0.89 | 1.20 × 0.76 | 32 mm wide with heavy center |
| 23 | 4002 | 110 | 0.64 | 1.27 × 0.76 | 76 mm wide |
| 24 | 4003 | 110 | 0.89 | 1.52 × 0.89 | 89 mm wide |
| 25 | 4005 | 114 | 1.02 | 1.91 × 1.14 | 102 mm wide |
| 26 | 4008 | 102 | 1.27 | 2.54 × 1.52 | 152 mm wide |
| 27 | 8003 | 78 | 0.89 | 1.65 × 0.76 | 178 mm wide with slight tails |
| 28 | 11003 | 42 | 1.27 | 1.91 × 0.76 | 330 mm wide with slight tails |

These examples show that several commercially available airless spray tips could be modified for aerosol container use to provide fan spray patterns from a cohesive polymer solution.

Various modifications and alterations of this invention will be apparent to those skilled in the art without departing from the scope and spirit of this invention and the latter should not be restricted to that set forth herein for illustrative purposes.

What is claimed is:

1. An aerosol can for spraying a polymer in a fan-shaped pattern comprising:

a can;

a valve mounted on said can;

a spray head including:

(a) a generally cylindrical inlet stem having an inlet end portion slideably and sealably mounted in said can valve and an outlet end portion, a central passageway between said inlet and outlet end portions, and at least one fluid metering passage through the side wall of said stem proximate said inlet end portion and communicating with said central passageway; and (b) a nozzle portion attached to said outlet end portion of said stem, said nozzle portion having an elongate groove which defines a terminal surface for said nozzle portion, said groove having a major axis, said nozzle portion further having an elongate chamber extending generally transverse to said stem with a central axis, an outlet end, and an inlet end communicating with said central passageway, and an orifice communicating with said outlet end of said elongate chamber and opening through said terminal surface, said orifice forming an elongate intersection with said terminal surface as viewed along said central axis, being generally centered in said groove, and having a major axis which is generally aligned with said major axis of said groove, wherein said major axis of said groove is longer than said major axis of said orifice;

a solution contained within said can of a polymer having a minimum number average molecular weight of approximately 10,000 and a solvent, the percentage by weight of said polymer in said solution being a value at which said solution exhibits non-Newtonian viscoelastic properties; and a propellant contained within said can which generates a pressure within said can and is sprayed with said solution.

2. An aerosol can according to claim 1, wherein said inlet stem is an integral part of said spray head and said central passageway has an inside diameter between about 1 and 3 mm.

3. An aerosol can according to claim 1, wherein said central axis of said elongate chamber is disposed at an included angle between about 90° and 120° with respect to said inlet stem.

4. An aerosol can according to claim 1, wherein said elongate chamber has a reduced cross-sectional area proximate said outlet end of said chamber.

5. An aerosol spray head according to claim 4, wherein said outlet end of said chamber has a substantially frustoconical shape proximate said orifice.

6. An aerosol can according to claim 1, wherein said elongate chamber has a mean diameter normal to said central axis between about 0.3 and 5 mm, and a length along said central axis between about 3 and 15 mm.

7. An aerosol can according to claim 1, wherein said outlet end of said chamber has a frustoconical shape proximate said orifice, said groove is V-shaped in cross section, and said orifice has a shape corresponding to two skewed, intersecting parabolas.

8. An aerosol can according to claim 1, wherein said orifice has a shape which when viewed along said central axis is rectangular, diamond-shaped, or elliptical.

9. An aerosol can according to claim 1, wherein said orifice has a minor axis with a length between about 0.4 and 1.6 mm, and a major axis with a length between about 0.9 and 2.5 mm.

10. An aerosol spray head according to claim 9, wherein said minor axis of said orifice has a length between about 0.8 and 0.9 mm, and said major axis of said orifice has a length between about 1.4 and 1.6 mm.

11. An aerosol can according to claim 1, wherein said groove is a V-shaped channel having sides disposed at an included angle between about 40° and 120°.

12. An aerosol spray head according to claim 11, wherein said sides are disposed at an included angle between about 80° and 100°.

13. An aerosol can according to claim 1, wherein said groove is U-shaped, square, rectangular, or trapezoidal in cross section.

14. An aerosol can according to claim 1, wherein said groove has open ends.

15. An aerosol can according to claim 1, wherein said groove is flanked by substantially planar lands.

16. An aerosol spray head according to claim 15, wherein said lands are coplanar.

17. An aerosol can according to claim 1, wherein said groove is bordered by substantially planar lands.

18. An aerosol can according to claim 1, wherein said groove is flanked by substantially convex or substantially concave lands.

19. An aerosol can according to claim 1 wherein said polymer is selected from a group consisting of polychloroprene copolymer; nitrile polymer; natural rubber adhesive consisting of pale crepe rubber and tall oil rosin; acrylic resin; butyl rubber; non-crosslinked SBR polymer; crosslinked SBR polymer; butadiene-styrene copolymer; heat activatable adhesive consisting of aliphatic segmented polyester and pentaerythritol ester of wood rosin; rubberized undercoating consisting of polychloroprene copolymer, alpha-pinene resin, asphalt, talc and carbon black; polychloroprene/-chlorinated natural rubber, urethane polymer and vinyl chloride-vinyl acetate copolymer.

20. An aerosol can according to claim 1 wherein said solvent is selected from a group consisting of water, aliphatic hydrocarbons, aromatic hydrocarbons, ketones, alcohols and esters.

21. An aerosol can according to claim 1 wherein said propellant is selected from a group consisting of ether, propane, isobutane, carbon dioxide, nitrous oxide and chlorofluorocarbon.

22. An aerosol can according to claim 1 wherein said pressure within said aerosol can generated by said propellant is below approximately 200 psi (1.36 megapascals).

* * * * *